US005691741A

United States Patent [19]

Kerigan et al.

[11] Patent Number: 5,691,741

[45] Date of Patent: Nov. 25, 1997

[54] DISPLAY APPARATUS WITH DATA COMMUNICATION CHANNEL

[75] Inventors: Shaun Carl Kerigan, Kilmalcolm; Andrew Ramsay Knox, Kilbirnie; Roger Timothy Wood, Largs, all of Great Britain

[73] Assignee: International Business Machines Corporation, Armonk, N.Y.

[21] Appl. No.: 378,325

[22] Filed: Jan. 26, 1995

[30] Foreign Application Priority Data

Jan. 29, 1994 [GB] United Kingdom ..... 9401701

[51] Int. Cl.[6] ..... G09G 5/00

[52] U.S. Cl. ..... 345/112; 345/132

[58] Field of Search ..... 345/132, 3, 112, 345/154–185

[56] References Cited

U.S. PATENT DOCUMENTS 4,528,561 7/1985 Kitamura ..... 345/132

FOREIGN PATENT DOCUMENTS

0456923A1 11/1991 European Pat. Off. .
2162026 1/1986 United Kingdom .
9306587 4/1993 WIPO .

OTHER PUBLICATIONS

IBM TDB, "Self–Identification Protocol Initialization", vol. 33, No. 10A, Mar. 1991, pp. 406–407.

*Primary Examiner*—Richard Hjerpe

*Assistant Examiner*—Regina Liang

*Attorney, Agent, or Firm*—Casimer K. Salys

[57] ABSTRACT

Display apparatus comprises a connection for releasably connecting a display device (130;130') to the display apparatus. A data input (MON_ID) receives first data from a first releasable connection (ST) to the display device (130;130') and for receiving second data from a second releasable connection (ID) to the display device (130;130'). Switch (320) selectively connects the data input (MON_ID) to either of the first releasable connection (ST) and the second releasable connection (ID). Display processor logic (310) is connected to the switch (320) for generating one or more video signals to generate an image on the display device (130,130') as a function of the data directed to the data input (MON_ID) from the display device (130;130') by the switch (320). Because the data input is switchable between connection to first data and second data from the display device, the display apparatus can identify and subsequently control both display devices which identify themselves by providing fixed reference levels on one or more lines of the output port and display devices which identify themselves by providing display identification data in a serial bit stream along a data communication channel. The same physical connector can be used to attach both kinds of display device to the video processor logic.

5 Claims, 5 Drawing Sheets

DISPLAY APPARATUS WITH DATA COMMUNICATION CHANNEL

BACKGROUND OF THE INVENTION

The present invention relates to display apparatus in which control data is communicated via a communication channel between a computer system and a display device.

The control data includes parameters for specifying the geometry and resolution of an image presented on the display device. In a display apparatus comprising a raster scanned display device such as for example a cathode ray tube (CRT) display device, these parameters are determined by the rates and durations of horizontal or line and vertical or frame scan signals generated for producing the raster scan by electrical circuits in the display device. To generate the image, the scan signals are synchronized to video signals from a video adaptor in the computer system by synchronization (sync) signals also generated by the video adaptor.

Some display devices can only operate in a single display mode characterized by a single set of parameters. Other display devices can be configured to operate in any one of a number of different display modes each characterized by a different set of parameters. The latter will hereinafter be referred to as multiple mode display devices.

Some recent display devices include display processor logic in the form of a microprocessor configured by computer program microcode to control the operation of the drive circuitry according to input line and frame sync pulses from the host computer system and to image parameter settings manually input via a user control panel. The display processor typically comprises a serial data input. Image parameter data corresponding to various different display modes is pre-loaded into the display processor via the serial data input during initial set up and testing of the display device.

In a display device controlled by a computer system it is desirable for the computer system to identify the type of display device so that appropriate video and sync signals can be generated. Many computer systems, such as the computer systems in the IBM PS/2 computer range for example, include a video graphics adaptor having an output port for connecting video and sync signals to the display device. The adaptor also has logic responsive to the manner in which identification pins in the output port are terminated when connected to the display device. The logic identifies the type of display device connected to the adaptor from these terminations.

UK Patent No. 2 162 026 describes an example of display apparatus employing a multiple-mode display device receiving video and sync signals from a computer system display adaptor. The display device can operate in any one of four different display modes. The computer system can be instructed to provide sync pulses of either positive or negative polarities. Each polarity combination indicates a different display mode. The display device includes decoding logic for configuring the display device to operate in a particular display mode in response to predetermined combinations of sync signal polarities and frequencies.

The conventional display apparatus hereinbefore described has the problem that the interface between the display device and the computer system can identify, and therefore generate appropriate controls signals for, only a limited number of different display devices. This limitation arises because of the number of pins available for device identification and control is limited by the physical form of the output port. Typically, the output port is implemented by a 15 pin connector.

European Patent Application No. 0 456 923 describes display apparatus comprising a display device for generating a visual output in response to input data signals defining data to be displayed. A display adaptor circuit generates the display data signals in a form specified by control data identifying the display device. An output port transmits the data signals from the display adaptor circuit to the display device and transmits the control data from the display device to the display adaptor circuit. A memory is located in the display device for storing the control data in the form of a plurality of control codes. Communication logic communicates control codes between the memory and the output port in response to a command signal from the display adaptor circuit.

The display apparatus described in EP-A-0 456 923 solves the problem of increasing the number of different display devices which can be identified and controlled by the computer system through the introduction of a control data communication channel between a memory in the display device and the video adaptor of the host computer system. The display adaptor in the computer system is adapted to receive display identification data from the display device via the communication channel. However, it is desirable for such a display adaptor to connect to not only to display devices in which provisions are made for the data communication channel and the storage of display identification data, but also to display devices in which no such provisions are made. There is hence an interest in providing both forwards and backwards compatibility in display apparatus of the kind described in EP-A-O 456 923.

SUMMARY OF THE INVENTION

In accordance with the present invention, there is now provided display apparatus comprising: means for releasably connecting a display device to the display apparatus; a data input for receiving first data from a first releasable connection to the display device and for receiving second data from a second releasable connection to the display device; switch means for selectively connecting the data input to either of the first releasable connection and the second releasable connection; and display processor logic connected to the switch means for generating one or more video signals to generate an image on the display device as a function of the data directed to the data input from the display device, by the switch means.

Because the data input is switchable between connection to first data from the display device and second data from the display device, the display apparatus of the present invention can identify and subsequently control both display devices which identify themselves by providing fixed reference on one or more lines of the output port and display devices which identify themselves by providing display identification data in a serial bit stream along a data communication channel. The same physical connector can be used to attach both kinds of display device to the video processor logic. The present invention therefore provides both forwards and backwards compatibility in display apparatus of the kind described in EP-A-0 456 923.

The switch means is preferably arranged to selectively connect the first connection to the display device to one of the data input and a control output for releasing the display device from a test mode of operation. This can prevent the display device from generating a test pattern such as, for example, a full raster image once the display is connected to the display apparatus of the present invention.

In a particularly preferred embodiment of the present invention, the switch means comprises: a header having a plurality of electrically conductive elements, the first connection, the second connection, the control output, and the data input being connected to different ones of the elements; a first electrically conductive jumper connector for releasably engaging different pairs of the conductive elements to link the data input to one of the first connection and the second connection; and a second electrically conductive jumper connector for releasably engaging different pairs of the conductive elements to link the first connection to the control output when data input is linked by the first jumper to the second connection.

It will be appreciated that the switch means may be implemented in a number of ways. However, the header and jumper arrangement is particularly preferred because it is relatively cheap and simple to introduce in comparison with other switch technologies. The data input can be switched between the first and second connections simply by moving the jumper from one pair of header to another.

It will be appreciated that the present invention extends to a computer system comprising display apparatus of the kind described in the preceding six paragraphs.

DESCRIPTION OF THE PREFERRED EMBODIMENT

Figure 1:
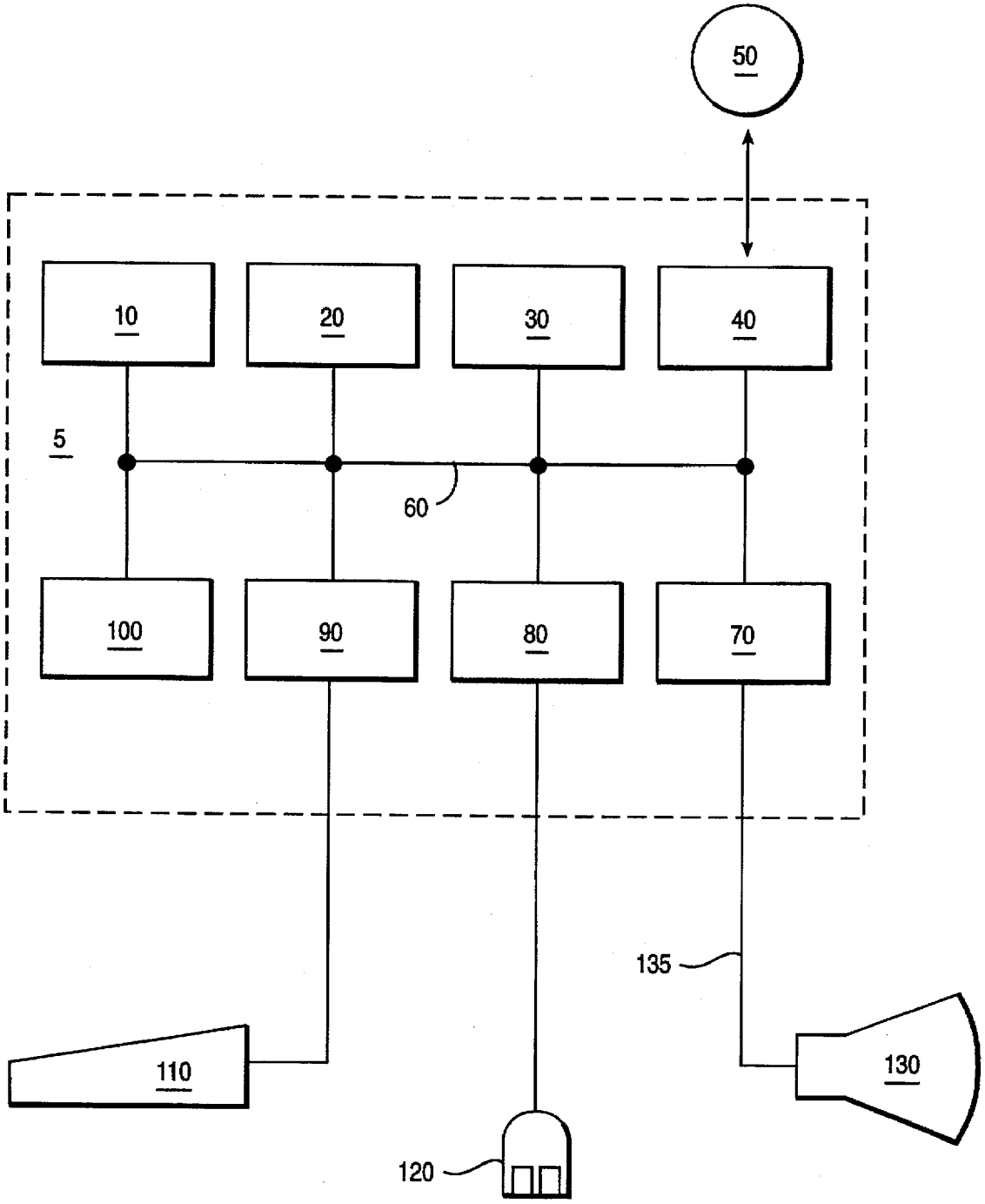
FIG. 1 is a block diagram of a computer system comprising display apparatus of the present invention.

Referring first to FIG. 1, a computer system comprises a system unit 5 including a random access memory (RAM) 10, a read only store (ROS) 20, a central processing unit (CPU) 30, a communication adaptor 40, a display adaptor 70, a pointing device adaptor 80, a keyboard adaptor 90, and a mass storage device 100 as a hard disk drive or tape streamer for example, all interconnected by a bus architecture 60. System unit 5 is connected via adaptor 90 to a keyboard 110. A pointing device 120 such as a touch screen, a tablet, or a mouse is connected to system unit 5 via adaptor 80. System unit 5 is also connected via adaptor 70 and an interface cable 135 to a display 130 such as a cathode ray tube (CRT) display or a liquid crystal display for example. A network 50 of other system units is connected to system unit 5 via communication adaptor 40.

In operation, CPU 30 processes data stored in a combination of RAM 10 and mass storage device 100 under the control of computer program code stored in a combination of ROS 20, RAM 10, and mass storage device 100. Communication adaptor 40 controls transfer of data and computer program code between system unit 5 and other system units in network 50 through communication adaptor 40. Keyboard and mouse adaptors 90 and 80 permit data and instructions to be manually entered into system unit 5 from keyboard 110 and pointing device 120 respectively. Display adaptor 70 translates output data from system unit 5 into video signals, R, G and B, and horizontal and vertical picture synchronization (sync) signals, H and V, for configuring display 130 to generate a visual data output. Bus architecture 60 coordinates data transfer between RAM 10, ROS 20, CPU 30, storage device 100, and adaptors 40, 90, 80 and 70.

Figure 2:
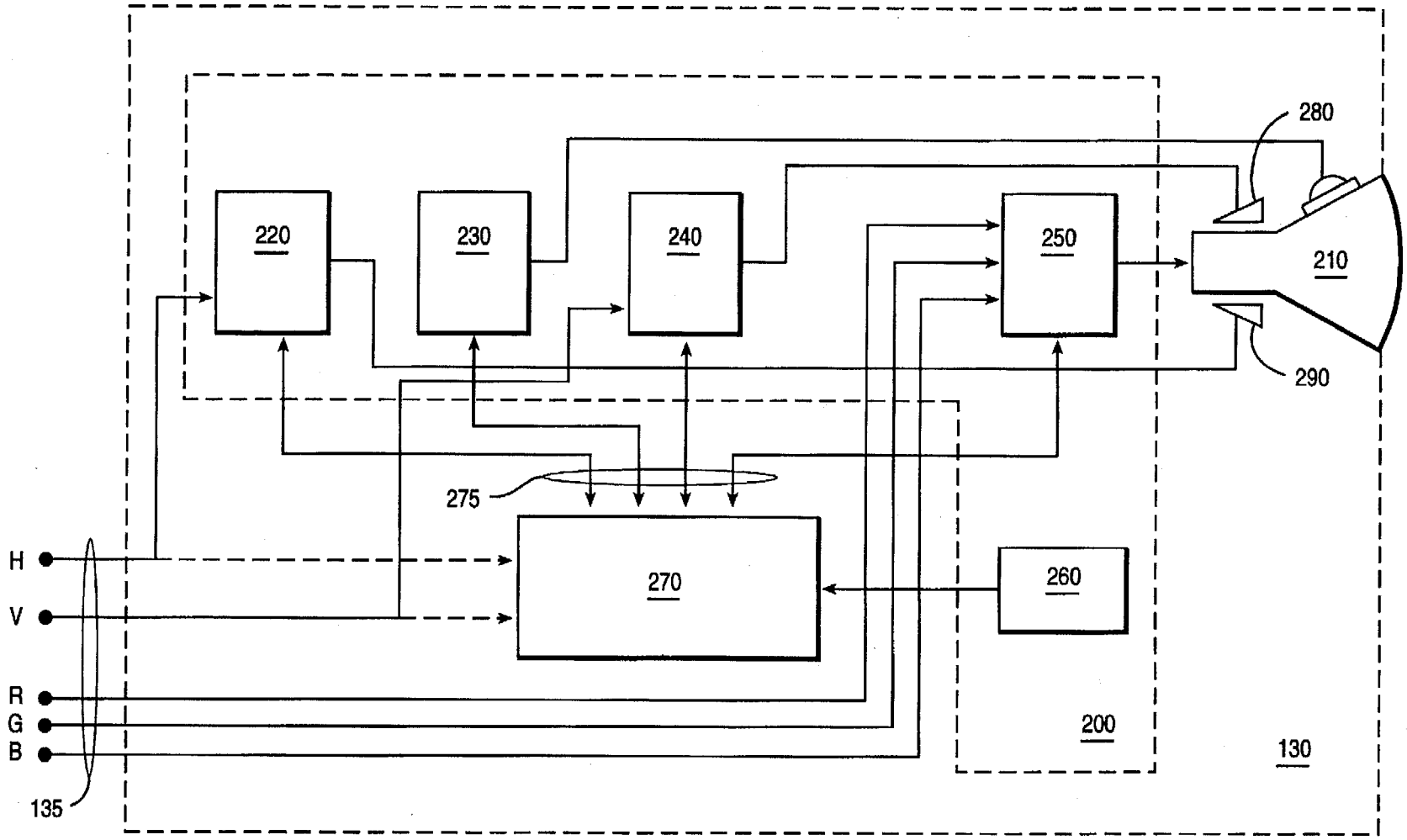
FIG. 2 is a block diagram of a display device for the computer system.

Referring now to FIG. 2, display 130 comprises a display screen 210 in the form of a color cathode ray display tube (CRT) connected to display drive circuitry 200. Display drive circuitry 200 comprises an Extra High Tension (EHT) generator 230 and a video amplifier 250 connected to display screen 210. Line and frame deflection coils 290 and 280 are disposed around the neck of the CRT. Deflection coils 290 and 280 are connected to line and frame scan circuits 220 and 240 respectively. Line scan circuit 220 and EHT generator 230 may each be in the form of a flyback circuit, the operation of which is well known by those skilled in the art. Furthermore, as is also well-known in the art, EHT generator 230 and line scan circuit 220 may be integrated in a single flyback circuit. A power supply (not shown) is connected via power supply rails (not shown) to EHT generator 230, video amplifier 250, and line and frame scan circuits 220 and 240. In use, the power supply provides electrical power on the supply rails from Line and Neutral connections (not shown) to the domestic electricity mains supply. The power supply may be in the form of a switch mode power supply, the operation of which is well-understood by those skilled in the art.

EHT generator 230, video amplifier 250, and line and frame scan circuits 220 and 240 are each connected to a display processor 270. Display processor 270 comprises processor logic preferably in the form of a microcomputer of the kind including microprocessor and accompanying memory. Drive circuitry 200 includes a user control panel 260 connected to key-pad interrupt lines of display processor 270. Control panel 260 comprises a plurality of manual operable switches.

In operation, EHT generator 230 generates an electric field within CRT 210 for accelerating electrons in beams corresponding to the primary colors of red, green and blue towards the screen of CRT. Line and frame scan circuits 220 and 240 generate line and frame scan currents in deflection coils 290 and 280. The line and frame scan currents are in the form of ramp signals to produce time-varying magnetic fields that scan the electron beams across the screen of CRT 210 in a raster pattern. The line and frame scan signals are synchronized by line and frame scan circuits to input line and frame synchronization (sync) signals H and V generated by video adaptor 70. Video amplifier 250 modulates the red, green and blue electron beams to produce an output display on CRT 210 as a function of corresponding red, green and blue input video signals R, G and B also generated by adaptor 70. Line and frame sync signals H and V and video signals R, G and B are supplied to display 130 from adaptor 70 along corresponding signal lines in interface cable 135. The signal lines of interface cable 135 terminate at the end remote from display device 130 in a connector (not shown) for detachably connecting the signal lines to adaptor 70. For compatibility, the connector is preferably a 15 pin D type connector although other connectors may be used.

Display processor 270 is configured to control the outputs of EHT generator 230, video amplifier 250, and line and frame scan circuits 220 and 240 via control links 275 as functions of preprogrammed display mode data and inputs from user control 260. The display mode data includes sets of preset image parameter values each corresponding to a different popular display mode such as, for example, 1024×768 pixels, 640×480 pixels, or 1280×1024 pixels. Each set of image display parameter values includes height and centering values for setting the output of frame scan circuit 240; and width and centering values for controlling line scan circuit 220. In addition, the display mode data includes common preset image parameter values for controlling the gain and cutoff of each of the red, green and blue channels of video amplifier 250; and preset control values for controlling the outputs of EHT generator 240. The image parameter values are selected by display processor 270 in response to input mode information from adaptor 70. The mode information is delivered from adaptor 70 to display processor 270 via line and frame sync lines H and V. Display processor 270 processes the selected image parameter values to generate analog control levels on the control links.

A user may also manually adjust the control levels controlling red green and blue video gains and cutoffs at video amplifier 250; and image width, height, and centering at line and frame scan circuits 220 and 240 via the user control panel 260. User control panel 260 includes a set of up/down control keys for each of image height, centering, width, brightness and contrast. When, for example, the width up key is depressed, user control panel 260 issues a interrupt to display processor 270. The source of the interrupt is determined by display processor 270 via an interrupt polling routine. In response to the interrupt from the width key, display processor 270 progressively increases the corresponding analog control level sent to line scan circuit 220. The width of the image progressively increases. When the desired width is reached, the user releases the key. The removal of the interrupt is detected by display processor 270, and the digital value setting the width control level is retained. The height, centering, brightness and contrast setting can be adjusted by the user in similar fashion. User control panel 260 further includes a store key. When the user depresses the store key, an interrupt is produced to which display processor 270 responds by storing in memory parameter values corresponding the current settings of the digital outputs to D to A convertor. The user can thus program into display 130 specific display image parameters according to personal preference.

Figure 3:
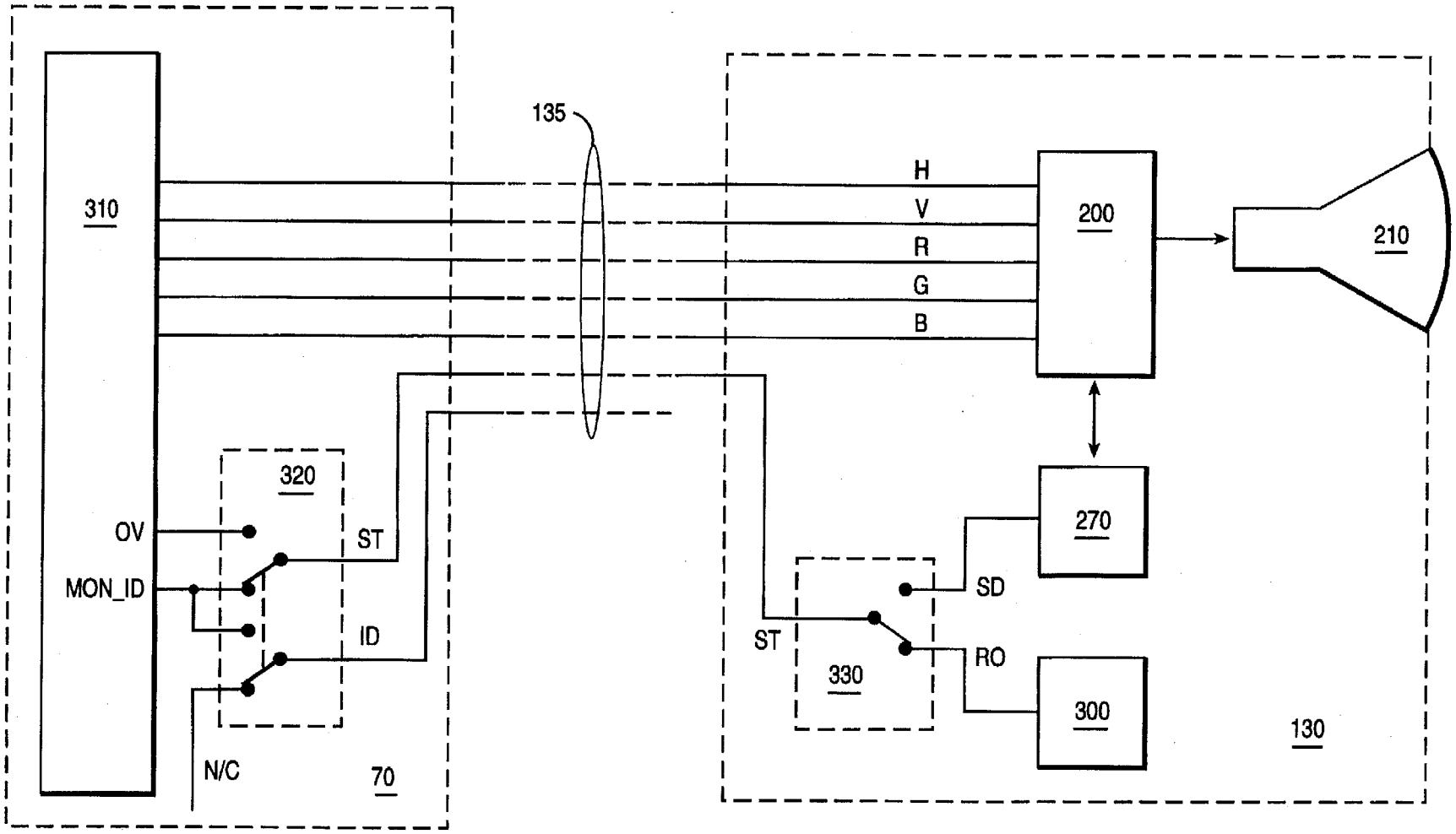
FIG. 3 is a block diagram of display apparatus of the present invention in a first configuration.

Referring now to FIG. 3, interface cable 135 also includes a self test line ST. In accordance with the present invention, self test line ST is selectively connectable to a serial data input SD of display processor 270 via switch means 330. During manufacture of display device 130, the aforementioned image parameter values may be pre-loaded into display processor 270 via the serial data input and self test line ST. Display device 130 also comprises a non-volatile memory 300 such as an EEPROM. The output RO of memory 300 is also selectively connectable to a self test line ST of interface cable 135 via switch means 330. Switch means 330 allows the self test line of interface cable 135 to be switched between connection to the serial data input SD to display processor 270 and the output of memory 300. In FIG. 3, switch means 330 is exemplified by a single pole double throw (SPDT) switch. Display adaptor 70 comprises video processor logic detachably connected to the line sync H, the frame sync V, and the R, G and B video lines of interface cable 135 via the aforementioned multi-pin connector (not shown). Video processor logic 310 has a ground line OV and a display identification input MON_ID. Input MON—ID is serial data input to video processor logic 310. Self test line ST of interface cable 135 is connectable, via switch means 320, to either ground line OV or input MON_ID to video processor 310. Interface cable 135 further comprises a display identification line ID which is unused for signal transmission. Display identification line ID can be switched via switch means 320 between input MON_ID of video processor logic 310 and an unconnected state denoted by N/C in FIG. 3. In FIG. 3, switch means 320 is exemplified by a double pole double throw (DPDT) switch.

Memory 300 contains a block of display identification data comprising of the order of 128 bytes of information fully describing the functional capabilities of display device 130. This data permits the computer system to configure adaptor 70 to provide, via video processor logic 310, the best possible signal match for the line and frame sync signals H and V, and the video signals R, G, and B, between adaptor 70 and display device 130. In operation, switch means 330 is normally set to connect self test line ST of interface cable 135 to output RO of memory 300. Switch means 320 in adaptor 70 is correspondingly set to connect self test line ST of interface cable 135 to the MON—ID input of video processor logic 310, with line ID of interface cable 135 left unconnected, at N/C, in adaptor 70. The display identification data stored in memory 300 can thus be serially read, one bit at a time, from memory 300 into input MON_ID of video processor logic 310 via switch means 330, self test line ST, and switch means 320. The display identification data is preferably clocked into input MON_ID as a function of the line sync signal H although it will be appreciated that other system clocks may be used to effect reading of the contents of memory 300. The transmission of the display identification data from memory 300 to video processor logic 310 is cyclic and continues as long as line sync signal H is present. After all the display identification data is read from memory 300 into video processor logic 310 at least once, ordering and interpretation of the display identification data within the computer system can be performed.

128 bytes of display identification data can thus be clocked from memory 300 into video processor logic 310 along self test line ST in a minimum of 1024 cycles of line sync signal. The display identification data can therefore by read in approximately two frame periods or around 30 ms. However, in multitasking computing applications, it is undesirable to inhibit interrupts of the computer system for 1024 or more cycles of the line sync signal. Furthermore, it is difficult to dynamically reconfigure adaptor 70 once operational. The display identification data is therefore read from display device 130 into adaptor 70 during initialization of the computer system. Initially, when the computer system is turned on or "booted up", Power On Self Test (POST) code is executed by CPU 30 to test that the computer system is operational. The initialization process continues following execution of the POST code with a device driver phase. In the device driver phase, device driver code for each of the peripheral device adaptors 40, 70, 80 and 90 of the computer systems is retrieved from mass storage 100 and installed in RAM 10 by CPU 30. The device driver code permits CPU 30 to control the peripheral device adaptors via bus architecture 60. The display identification data is read from memory 300 in display device 130 into video processor logic 310 of adaptor 70 during the device driver phase so that the associated disabling of interrupts does not significantly impede the operation of the computer system. The display identification data is not read during the POST because display device 130 might not be switched by then, in which case the display identification would not be available. Typically a significant period lapses between turn on and the beginning of the device driver phase. The operator thus has time to turn on the display after turning on the computer system.

The device driver code for adaptor 70 uses Video Basic Input Output System (VBIOS) code to read the display identification data bit by bit and to align the align the data read into bytes. Conventional device drivers rely on user intervention to set the resolution and line and refresh rates (line and frame sync frequencies) for the display device attached. The user intervention is generally prompted by utilities provided with the various adaptors available. These utilities vary in quality. The display identification data provided in accordance with the present invention gives the device driver all the information generally required by the utilities, together with additional information that the user may not have to hand, to allow the computer system to select the most appropriate fonts or refresh rates, for example. This permits the user to optimize the performance of the computer system.

During manufacturing or field servicing for example, switch means 330 can be set to connect self test line ST of interface cable 135 to input SD display processor 270 instead of to output RO of memory 300. Test data can then be serially loaded into display processor 270 from a suitable test station on the production line to test display device 130 prior to shipment. The aforementioned preset image parameter values forming the display mode data used in display processor 270 can also be loaded into display processor 270 in this manner.

Figure 4:
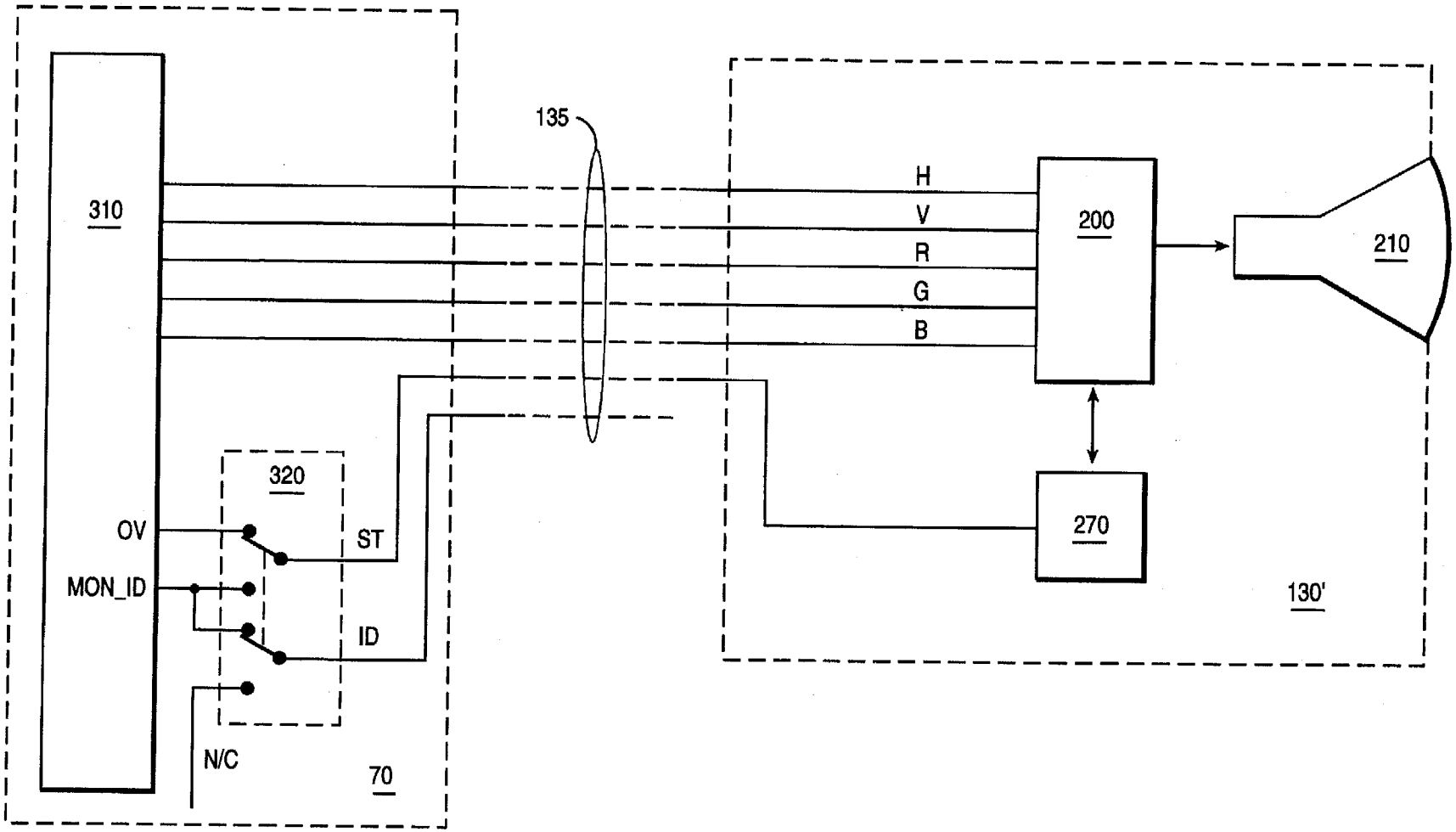
FIG. 4 is a block diagram of display apparatus of the present invention in a second configuration.

In some circumstances, it may be desirable to use adaptor 70 to drive conventional display devices that do not have the ability to provide display information (ie: do not have memory 300). A typical example of such a conventional display device is able to present a four bit identification code to a display adaptor of a computer system via four ID bit lines included in its interface cable. This conventional display device also generates a test raster image when the self test line of its interface cable is not grounded by the computer system. Referring now to FIG. 4, compatibility with a conventional display device 130' of this kind just described is achieved in accordance with the present invention through switch means 320. Switch means 320 can be set to connect self test line ST to system ground 0V instead of to data input MON_ID and to connect ID line to data input MON_ID instead of leaving it unconnected. When switch means 320 is set to connect self test line ST to system ground 0V and conventional display device 130' is attached to adaptor 70, the test raster generator of the conventional display device 130' is disabled. However, adaptor 70 can still identify conventional display device 130' because the ID line of its interface cable now connected to the data input MON_ID of video processor logic 310 via switch means 320. Adaptor 70 therefore provides backwards compatibility with conventional displays as well as forwards compatibility with displays able to provide display identification data.

In the embodiments of the present invention depicted in FIGS. 3 and 4, switch means 320 and 330 are implemented by DPDT and SPDT switches respectively. However, it will be appreciated that in other embodiments of the present invention, switch means 320 and 330 may be implemented using other techniques. For example, in other embodiments of the present invention, switch means 320 and 330 may each be implemented electronically by multiplexer logic or the like.

Figure 5A:
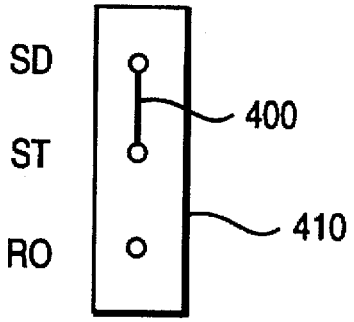
FIGS. 5A and 5B are plan views of first switch means for display apparatus of the present invention.
Figure 5B:
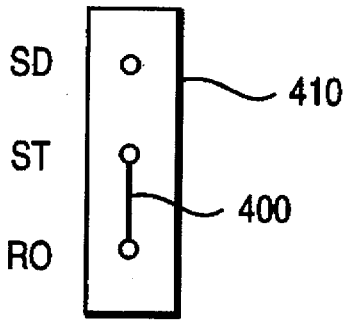
Figure 6A:
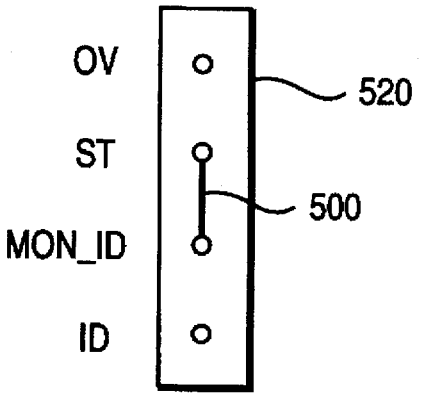
FIGS. 6A and 6B are plan views of second switch means for display apparatus of the present invention.
Figure 6B:
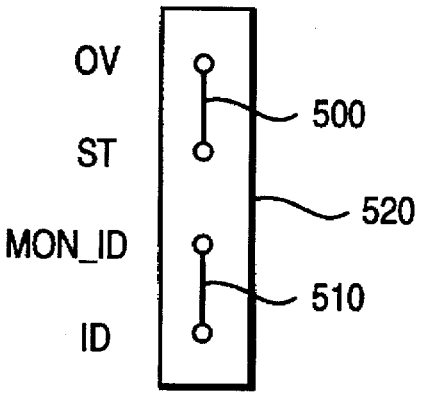

Referring now to FIGS. 5*A* and 5*B*, in particularly preferred embodiments of the present invention, switch means 330 is implemented by printed circuit board mounted 3 pin header 410 and a pluggable jumper connector 400 for connecting adjacent pairs of the pins of header 400. The pins of header 400 are connected to self test line ST of interface cable 135, serial data input SD to display processor 270 and output RO of memory 300, respectively. Jumper 400 can be manually plugged to connect self test line ST to either serial input SD as shown in FIG. 5*A* or to memory output RO as shown in FIG. 5*B*. Referring now to FIGS. 6*A* and 6*B*, in particularly preferred embodiments of the present invention, switch means 320 is implemented by printed circuit board mounted 4 pin header 520 and pluggable jumper connectors 500 and 510 for connecting adjacent pairs of the pins of header 500. The pins of header 520 are connected to system ground OV of video processor logic 310, self test line ST of interface cable 135, serial input MON_ID to video processor logic 310, and identification line ID of interface cable 135. With reference to FIG. 6*A*, to configure adaptor 70 for connection to display device 130 having memory 300, jumper 500 is plugged into header 520 to connect self test line ST to data input MON_ID. Referring to FIG. 6B, to configure adaptor 70 for connection to a conventional display device, jumper 500 is plugged into header 520 to connect self test line ST to system ground OV and additional jumper 510 is plugged into header to link data input MON_ID to identification line ID.

The implementations of switch means 330 and 320 described above with reference to FIG. 4 and 5 are particularly attractive by reason of their simplicity relative to other technologies such as electronic multiplexers or other mechanical multi-pole switches.

Embodiments of the present invention have been hereinbefore described with reference to a color CRT display device. However, it will be appreciated that the present invention is equally applicable to display apparatus comprising other forms of display screens such as, for example, monochrome CRTs, or liquid crystal display panels and the like.

We claim:

1. Display apparatus, comprising:

a connector for connecting a display device (130;130') to the display apparatus;

a data input (MON_ID) for receiving first data, in serial data bit stream format, from a first output (ST) of the display device (130;130') and for receiving second data from a second output (ID) of the display device (130;130');

switch means (320) for selectively connecting the data input (MON_ID) to either of the first output (ST) or the second output (ID); and display processor logic (310) connected to the switch means (320) for generating one or more video signals to generate an image on the display device (130,130') as a function of the data directed to the data input (MON_ID) by the switch means (320).

2. Apparatus as claimed in claim 1, wherein the second data is in the form of a reference level.

3. Apparatus as claimed in any preceding claim, wherein the switch means (320) is arranged to selectively connect the first output (ST) to the display device (130;130') to one of the data input (MON_ID) and a control output (0V) for releasing the display device (130;130') from a test mode of operation.

4. Apparatus as claimed in claim 3, wherein the switch means (320) comprises: a header (520) having a plurality of electrically conductive elements, the first output (ST), the second output (ID), the control output (0V), and the data input (MON_ID) being connected to different ones of the elements; a first electrically conductive jumper connector (500) for releasably engaging different pairs of the conductive elements to link the data input (MON_ID) to one of the first output (ST) and the second output (ID); and a second electrically conductive jumper connector (510) for releasably engaging different pairs of the conductive elements to link the first output (ST) to the control output (0V) when data input (MON_ID) is linked by the first jumper (500) to the second output (ID).

5. A computer system, comprising:

a processing unit (30);

a display adapter (70) connected and responsive to the processing unit (30);

a connector for connecting a display device (130;130') to the display adapter (70);

a data input (MON_ID) for receiving first data, in serial data bit stream format, from a first output (ST) of the display device (130;130') and for receiving second data from a second output (ID) of the display device (130;130');

switch means (320) for selectively connecting the data input (MON_) to either of the first output (ST) or the second output (ID); and display processor logic (310) connected to the switch means (320) for generating one or more video signals to generate an image on the display device (130;130') as a function of the data directed to the data input (MON_) by the switch means (320).

* * * * *